US008784117B2

(12) United States Patent
An et al.

(10) Patent No.: US 8,784,117 B2
(45) Date of Patent: Jul. 22, 2014

(54) ELECTRICAL CONNECTOR WITH X-TYPE DUAL SPRING CONTACTS FOR LOWER PROFILE AND LATTICE SHIELDING THEREWITH

(75) Inventors: Alex Lon An, San Jose, CA (US); Darrell Lynn Wertz, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 51 days.

(21) Appl. No.: 13/551,588

(22) Filed: Jul. 17, 2012

(65) Prior Publication Data

US 2014/0024231 A1 Jan. 23, 2014

(51) Int. Cl.
*H01R 12/00* (2006.01)

(52) U.S. Cl.
USPC ..... 439/66

(58) Field of Classification Search
USPC ..... 439/66, 82, 71; 174/255, 261; 361/777
See application file for complete search history.

(56) References Cited

U.S. PATENT DOCUMENTS 5,228,861 A * 7/1993 Grabbe ..... 439/66
5,608,192 A * 3/1997 Moriizumi et al. ..... 174/255
5,730,606 A 3/1998 Sinclair
6,353,190 B1 * 3/2002 Sumida et al. ..... 174/261
6,512,187 B2 * 1/2003 Sumida et al. ..... 174/261
6,938,338 B2 * 9/2005 Fjelstad et al. ..... 29/874
7,059,865 B2 * 6/2006 Kister et al. ..... 439/66
D525,207 S * 7/2006 Kister et al. ..... D13/154
7,074,048 B2 7/2006 Liao et al.
7,095,107 B2 * 8/2006 Ramakrishnan et al. ..... 257/691
7,189,078 B2 * 3/2007 Kister et al. ..... 439/66
7,245,137 B2 * 7/2007 Eldridge et al. ..... 324/754.07
7,383,632 B2 * 6/2008 Dittmann ..... 29/884
7,448,909 B2 * 11/2008 Regnier et al. ..... 439/607.05
7,597,561 B2 * 10/2009 Radza et al. ..... 439/66
7,633,766 B2 * 12/2009 Regnier et al. ..... 361/777
7,645,147 B2 * 1/2010 Dittmann ..... 439/82
7,658,618 B2 * 2/2010 Ochiai ..... 439/66

* cited by examiner

*Primary Examiner* — Alexander Gilman
(74) *Attorney, Agent, or Firm* — Wei Te Chung; Ming Chieh Chang

(57) ABSTRACT

An electrical connector for connecting a package and a mother board includes an insulating sheet defining a top surface confronting with the package and a lower surface confronting with the mother board, and a plurality of contacts. The insulating sheet has a plurality of through holes through the top surface and the lower surface thereof and arranged in a matrix. The plurality of contacts is pressed in the corresponding through holes from the top surface of the insulating sheet. Each contact includes a main plate, a pair of first contacting arms from opposite edges of the main plates for contacting with the package and a pair of second contacting arm from another opposite edges of the main plate for contacting with the board.

20 Claims, 8 Drawing Sheets

ELECTRICAL CONNECTOR WITH X-TYPE DUAL SPRING CONTACTS FOR LOWER PROFILE AND LATTICE SHIELDING THEREWITH

BACKGROUND OF THE INVENTION

1. Field of the Invention

The present invention relates to an electrical connector, and more particularly to an ultra-thin CPU socket with X-type dual spring contacts, which have a low-profile socket for notebook industry and connection with CPU and mother board.

2. Description of Related Art

Electrical connectors used to interconnect a central processing unit (CPU) to a printed circuit board (PCB) can be categorized into an Land Grid Array (LGA), a Ball Grid Array (BGA), and a Pin Grid Array (PGA).

An LGA-BGA connector disclosed in U.S. Pat. No. 7,074,048 which issued to Liao et al. on Jul. 11, 2006 includes an insulating housing having a plurality of passageways extending therethrough and a plurality of conductive contacts respectively received in the passageways of the insulating housing. Each contact has a base portion, an elastic arm and a solder portion extending from opposite sides of the base portion, and a contacting portion located at a free end of the elastic arm. The solder portion has a solder ball attached thereon. The LGA-BGA connector establishes electrical connecting between the CPU and the PCB by reflowing the solder portions of the contacts to conductive pads of the PCB and the contacting between the contacting portions of the contacts and conductive pads of the CPU.

However, the height of the connector is increased by the structure of the contacts, so that the connector can not meet the development tread of low height.

U.S. Pat. No. 5,730,606 which issued to William on Mar. 24, 1998 discloses an electrical connector. The electrical connector includes an insulating housing having a plurality of passageways extending therethrough and a plurality of contacts received in corresponding passageways. Each contact comprises a planar horizontal base portion having an upper surface and a lower surface opposite to each other, a pair of opposing arms and a pair of resilient opposing tangs extending upwardly from the upper surface of the base portion. The contact has a fusible member attached to the lower surface thereof The electrical connector establishes electrical connection between the CPU and the PCB through the arms of the contacts clamping solder balls of the CPU and soldering the contacts to the PCB by fusible members. However, the electrical connector needs to predeterminately solder fusible members to the lower surfaces of the base portions, so as to increase costs and make process complex.

Another existing electrical connecting device comprises a printed circuit board (PCB) having a plurality of fusible members attached thereon and a central processing unit (CPU) with a plurality of solder balls. The electrical connecting device establishes electrical connection between the CPU and the PCB through the solder balls of the CPU being directly welded with the fusible members of the PCB. The electrical connecting device does not have an electrical connector located between the CPU and the PCB, so as to reduce the height of the electrical connecting device and make cost down. However, the CPU can be hardly removed in case of rework after the CPU is directly welded to the PCB.

In view of the above, an improved electrical connector for electrically connecting the CPU with the PCB is needed.

SUMMARY OF THE INVENTION

Accordingly, an object of the present invention is to provide an electrical connector for low profile application.

In order to achieve the above object, an electrical connector for connecting a package and a mother board in accordance with a preferred embodiment of the present invention, comprises an insulating sheet defining a top surface confronting with the package and a lower surface confronting with the mother board, and a plurality of contacts. The insulating sheet has a plurality of through holes through the top surface and the lower surface thereof and arranged in a matrix. The plurality of contacts is pressed in the corresponding through holes from the top surface of the insulating sheet. Each contact comprises a main plate, a pair of first contacting arms from opposite edges of the main plates for contacting with the package and a pair of second contacting arm from another opposite edges of the main plate for contacting with the board.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
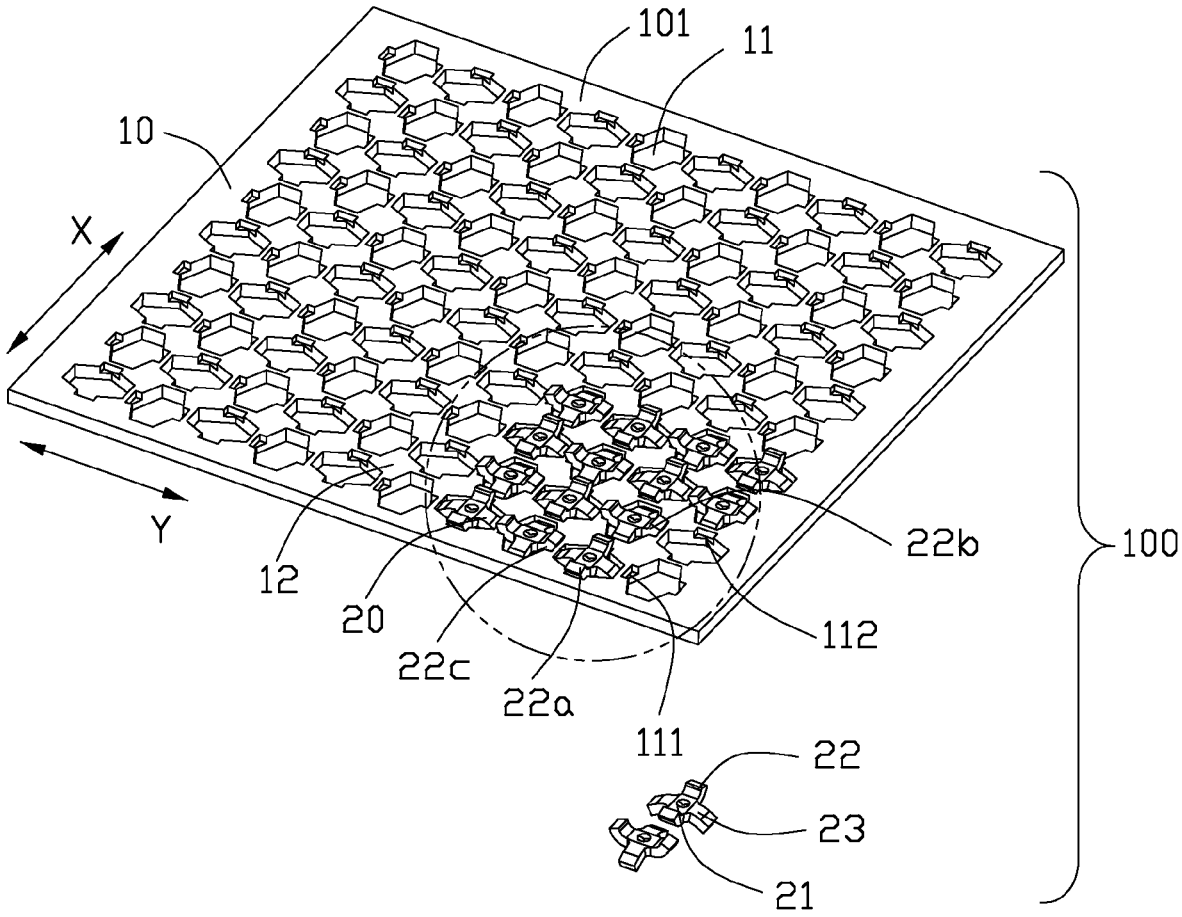
FIG. 1 is an exploded perspective view of an electrical connector in accordance with a preferred embodiment of the present invention.
Figure 2:
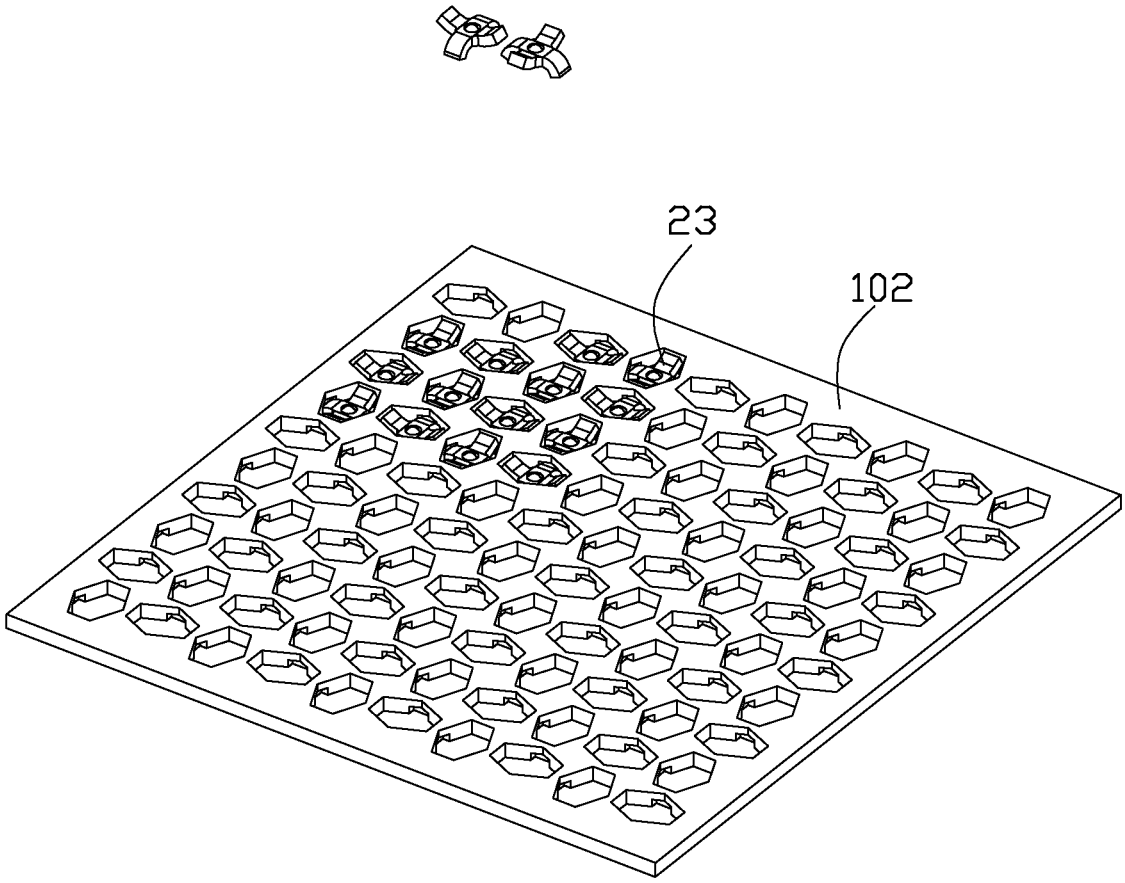
FIG. 2 is similar to FIG. 1, but taken from a bottom aspect.
Figure 3:
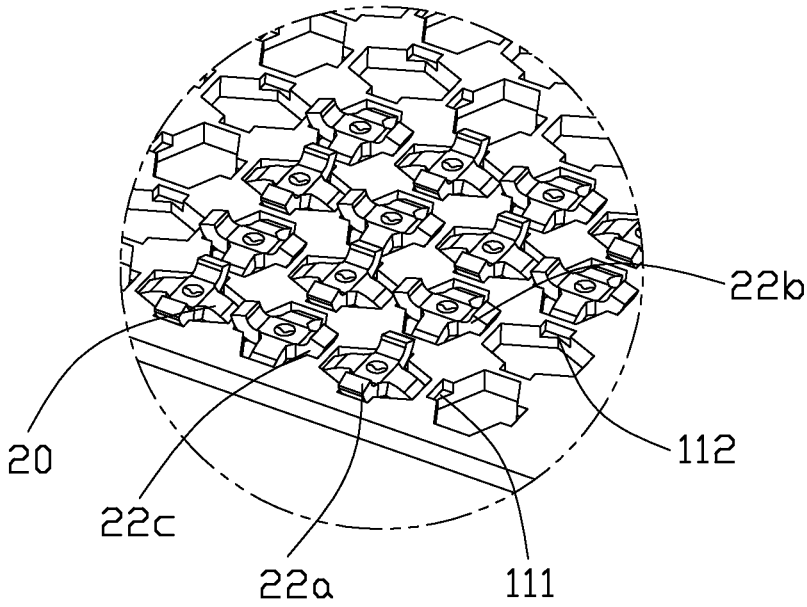
FIG. 3 is an enlarged view circled in FIG. 1.

FIGS. 1-3 illustrate an electrical connector 100 in accordance to a preferred embodiment of the present invention, which is generally used for connecting a package, for example a CPU with a plurality of conductive pads to a mother board (not shown) with a plurality of conductive pads. The electrical connector 100 comprises a thin insulating member or sheet 10 which is thinner than insulating housings of the convention electrical connectors. The insulating sheet 10 defines a plurality of through holes 11 extending through a top surface 101 confronting with the package and a lower surface 102 confronting with the mother board, and a plurality of contacts 20 respectively received in the through holes 11. The through holes 11 are arranged in matrix (along the X direction and Y direction) and each is hexagon in nature from a top view with six inner sides and six corners. Each through hole 11 further defines a pair of shifting recesses 111 at two opposite corners of the hexagon, which open upward through the top surface 101 and communicating with corresponding through hole 11. The adjacent through hole 11 defines another pair of shifting recesses 112 at another opposite corners of the hexagon either along the X direction or along the Y direction.

The contacts 20 are X-types, each includes a main plate 21 with four edges, two pairs of contacting arms extending radially outwardly from the opposite edges of the main plate 21. The pair of first contacting arms 22 slants upwards from two opposite edge of the main plate 21 and protrudes upwards beyond the top surface each with a contacting tip to contact with the package. The pair of second contacting arms 23 slants downwards from opposite edges of the main plate 21. The contacts 20 are pressed downwards from the top surface so that the second contacting arms 32 are pointed down to be fitted into through holes 11 of insulating sheet to frictionally retain the contacts in the through holes 11. The pair of first contacting arms 22 are partly received in the shifting recesses 111, 112, so that the first contacting arms can shift downwards when the package are pressed against the first contacting arms 22. The free ends of the second contacting arms project downwards beyond the lower surface 102 to be seated on corresponding one conductive pad of the mother board. Alternatively, the second contacting arms are retained on the inner side of the though holes and the main plate 21 are connecting with the mother board by solder balls (not shown).

The adjacent pairs of first contacting arms 22*a*, 22*b*, 22*c* loaded in the insulating sheet 10 are orthogonal to each other. The adjacent pairs of the second contacting arms 23 are orthogonal to each other since the pair of the second contacting arms 23 is orthogonal to the pair of first contacting arms of a same contact. As best shown in FIG. 1, there is a large blank remainder area 12 among every four through holes 11 which can be used to set conductive pillars with shielding lattice, which be described below. The X-type contacts have reduced pitch for replacing conventional contact barbs so that the contacts can be used in low profile sockets.

Figure 4:
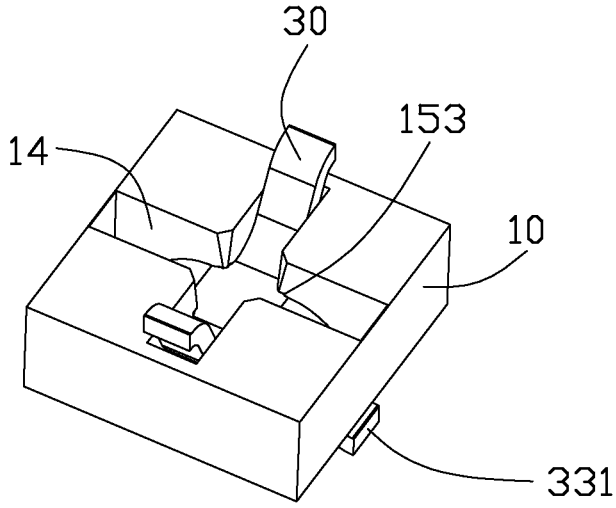
FIG. 4 is an enlarged perspective view of one improved contacts in one through hole of this invention.
Figure 5:
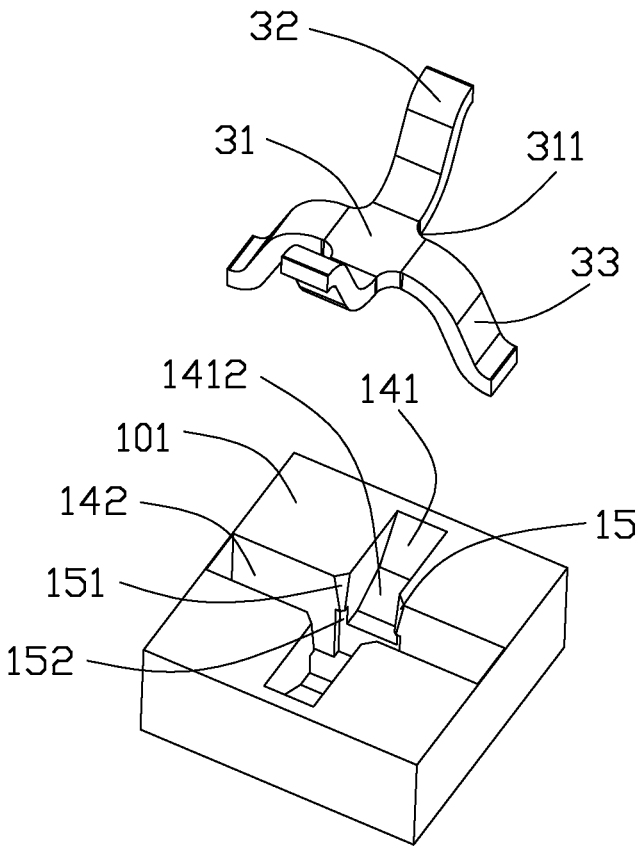
FIG. 5 is an exploded perspective view of the contact shown in FIG. 4.

Referring to FIGS. 4 and 5 shown an improvement of the contacts of the electrical connector shown in FIG. 1, the through holes 14 to load the plurality of contacts 30 are of a cross shape which includes a pair of shifting recesses 141 and a pair of through recesses 142. The contacts are also of an X type, which includes a main plate 31 with a pair of first contacting arms 32 receiving in the shifting recesses 141 and a pair of second contacting arms 33 receiving and running through the through recesses 142 so as the free ends 331 of the second contacting arms connect with the mother board. Four corners 15 between the shifting recesses 141 and the through recesses 142 are configured with an abrupt slope 151 at an upper portion thereof and a recessed groove 152 communicating with the through hole 14. The contact has rounded-edges 311 at joints of the said four contacting arms. The contacts are inserted in the through holes 14 from a top surface 101 of the housing sheet 10, wherein the rounded edges 311 are guided to straddle over the abrupt slopes 151 until the rounded edges 311 fall into the recessed grooves 152. As a response, the contacts 30 are limited from upward-movement by the downward stopping faces 153 and the first contacting arms 32 of the contacts are seated in the shifting recesses 141 to prevent the contacts from downwards slipping off.

Figure 6:
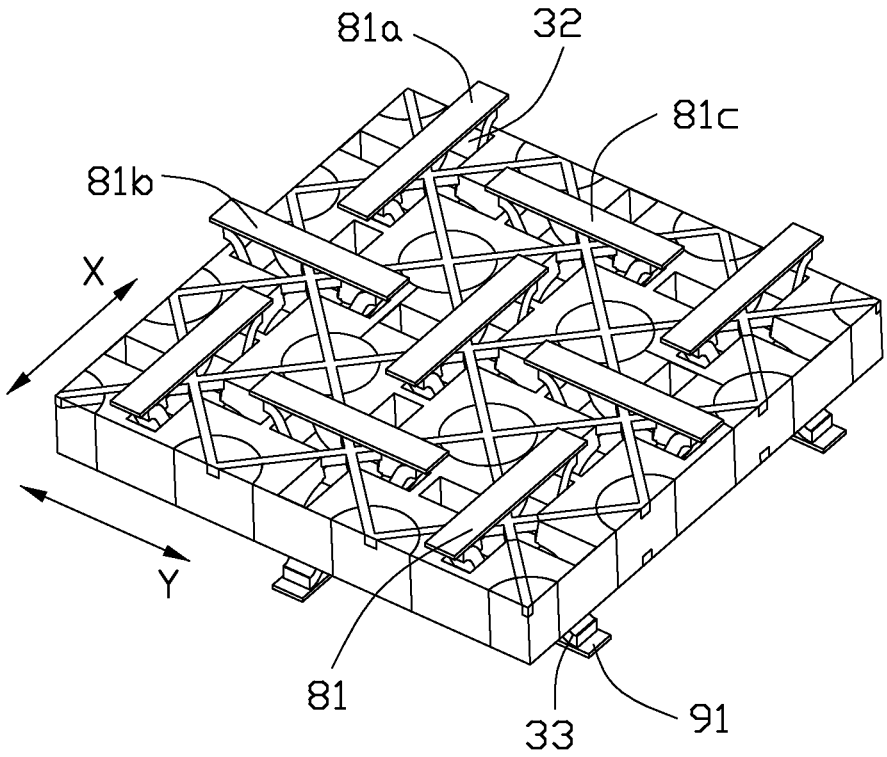
FIG. 6 is a perspective view of an improved electrical connector of this invention.
Figure 7:
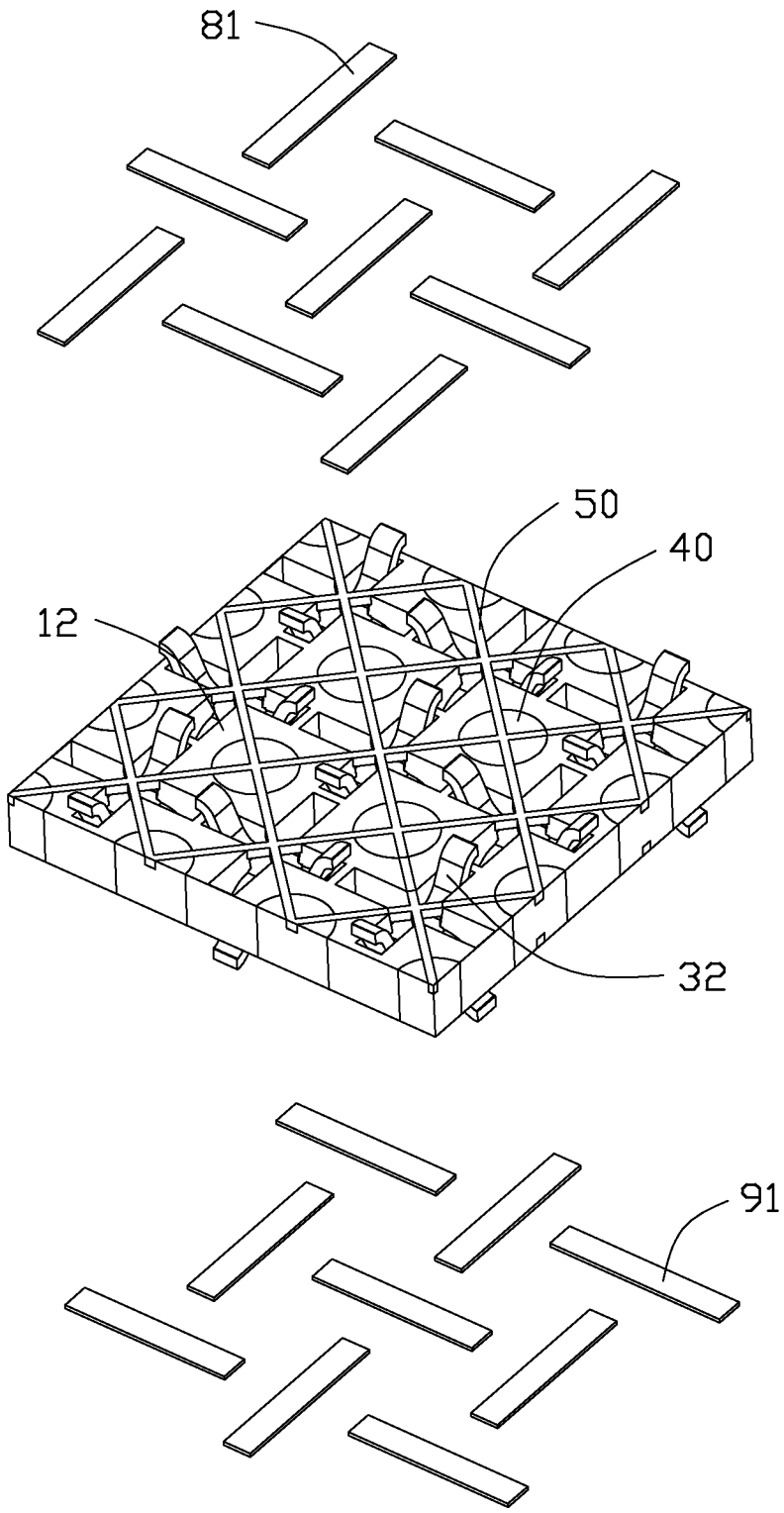
FIG. 7 is an exploded perspective view of the improved electrical connector shown in FIG. 6.
Figure 8:
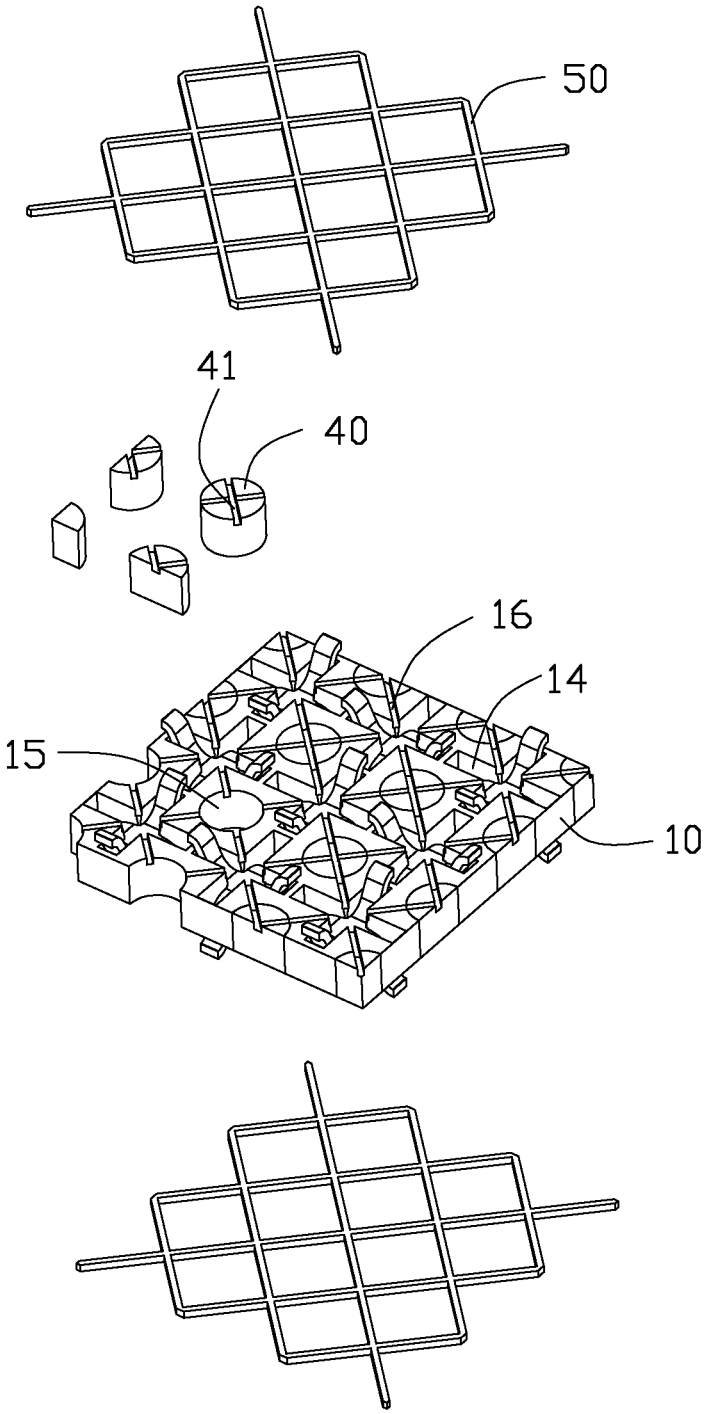
FIG. 8 is an exploded perspective view of the improved electrical connector shown in FIG. 6.

FIGS. 4 and 5 only illustrate one through hole 14 and one contact and a matrix of the contacts 30 is shown in FIGS. 6 to 8. Referring to FIGS. 6 to 8, the pairs of first contacting arms 32 connect with rectangular conductive pads 81 defined on the package and the pairs of second contacting arms 33 connect with rectangular conductive pads 91 defined on the mother board. The conductive pads 81, 91 of the package and the mother board connecting with a same contact are perpendicular to reach other. The adjacent conductive pads 81*a*, 81*b* along the rows are arranged perpendicular to each other and the adjacent conductive pads 81*a*, 81*c* along the columns are also arranged perpendicular to each other. The pattern arrays of the X-shaped contact produce a lower-paced pitch reduction for PCB pads.

The remainder area 12 among every four adjacent through holes 14 are efficiently used with a through aperture 15 to load with conductive poles 40. The housing sheet 10 defines lattice slots 16 across the through holes 14 at the top and lower surfaces thereof to receive a shielding lattice 50 respectively for highly reduced risk of shorting. The conductive poles also define lattice slots 41 following the lattice slots 16 on the insulating sheet. The shielding lattice 50 connects with the poles 40 for shielding between contacts for better signal integrity. The shielded contacts allow contact reduction by reducing demand for ground pins. The shielding lattices 50 go across the first/second contacting arms of the pairs to avoid shorting on a basic of an effective use of space. One assembly procedure of the shielding lattice and the conductive poles is introduced that the shielding lattice placement is done after the stitched contacts 30 are pressed into housing sheet 10 with carrier at top tails of the contacts and then the poles into the through holes 15 to connect of the shielding lattice 50. The conductive poles are made from thermoset pillars, conductive elastomer or metal material. Another assembly procedure of the shielding lattice and the poles is alternatively adopted that insertion of the poles 40 in the through aperture 15 is done after the stitched contacts 30 are pressed into insulating sheet 10 and then the shielding lattice 50 is placed to the lattice slots. Lastly, thin film with printed trace lattice is layered above the insulating sheet 10 to connect poles.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting a package and a mother board comprising:

an insulating sheet defining a top surface confronting with the package and a lower surface confronting with the mother board, the insulating sheet having a plurality of through holes through the top surface and the lower surface thereof and arranged in a matrix; and a plurality of contacts pressed in the corresponding through holes from the top surface of the insulating sheet, each contact comprising a main plate, a pair of first contacting arms from opposite edges of the main plates for contacting with the package and a pair of second contacting arm from another opposite edges of the main plate for contacting with the board;

wherein the through holes are of a cross shape and have four corners, each of the corners defines an abrupt slope at an upper portion thereof and a recessed groove below the an abrupt slope, the main plates are guided to straddle over the abrupt slopes and fall in the recessed grooves from moving toward the top surface.

2. The electrical connector as claimed in claim 1, wherein the contacts are frictionally fitly in the through holes by the second contacting arms.

3. The electrical connector as claimed in claim 1, wherein each cross shaped through hole include a pair of shifting recesses receiving the pair of first contacting arms and a pair of through recesses through the lower surface receiving the pair of second contacting arms.

4. The electrical connector as claimed in claim 1, wherein the electrical connector comprises metal poles and shielding lattices, the insulating sheet defines through apertures among every four through holes loading with the contacts to receive the pole, the shielding lattices lay on the top surface and the lower surface and connect with the poles.

5. The electrical connector as claimed in claim 4, wherein the shielding lattices go obliquely across the first and the second contacting arms.

6. An electrical connector comprising:

an insulative housing defining a plurality of passageways arranged in matrix with rows and columns defining corresponding row and column directions perpendicular to each other, each of said passageways extending through opposite upper and lower surfaces of the housing;

a plurality of contacts disposed in the corresponding passageways, respectively;

a lattice shielding applied upon at least one of said upper and lower surfaces of the housing and interwoven with the passageways; wherein said lattice shielding is made of intersected strips extending along different oblique directions oblique to both said row direction and said column direction;

a plurality of conductive poles respectively located at corresponding nodes of the intersected strips.

7. The electrical connector as claimed in claim 6, wherein said conductive poles are displayed along both said row directions and said column directions.

8. The electrical connector as claimed in claim 6, wherein said different oblique directions include two diagonal directions of a square configuration.

9. The electrical connector as claimed in claim 6, wherein the conductive poles are arranged with every other nodes along both said different oblique directions.

10. The electrical connector as claimed in claim 9, wherein the nodes without the poles therewith are centers of the corresponding passageways.

11. The electrical connector as claimed in claim 6, wherein each of said contacts defines at least one upper contacting section and at least one lower contacting section respectively exposed upon the upper surface and the lower surface of the housing along the row direction and the column direction, respectively.

12. The electrical connector as claimed in claim 11, wherein in some of said contacts, each defines a cross-like configuration in a top view with a horizontal rectangular main plate located at a mid-level of the housing, a pair of upper contacting arms upwardly extending from two opposite edges of the main plate in the row direction, and another pair of lower contacting arms downwardly extending from the other two opposite edges of the main plate in the column direction.

13. The electrical connector as claimed in claim 12, wherein the main plate is essentially located at a center of the corresponding passageway.

14. The electrical connector as claimed in claim 13, wherein each of said passageways defines a cross-like configuration in the top view.

15. The electrical connector as claimed in claim 14, wherein in each of said passageways, the housing defines a pair of upward supporting planes to support an underside of the main plate around the corresponding opposite two edges, and a pair of recessed grooves with four downward supporting plates to limit an upper face of the main plate so as to retain the contact in position in the corresponding passageway.

16. The electrical connector as claimed in claim 15, wherein the adjacent two cross-like passageways in either the row direction or the column direction have ninety degrees orientation difference in the top view.

17. The electrical connector as claimed in claim 12, wherein in remainder of said contacts, each defines a cross-like configuration in a top view with a horizontal rectangular main plate located at a mid-level of the housing, a pair of upper contacting arms upwardly extending from two opposite edges of the main plate in the column direction, and another pair of lower contacting arms downwardly extending from the other two opposite edges of the main plate in the row direction.

18. The electrical connector as claimed in claim 17, wherein said some of the contacts and said remainder of the contacts are alternately with each other in both the row direction and the column direction.

19. An electrical connector comprising:

an insulative housing defining a plurality of passageways arranged in matrix with rows and columns defining corresponding row and column directions perpendicular to each other, each of said passageways extending through opposite upper and lower surfaces of the housing;

a plurality of contacts disposed in the corresponding passageways, respectively;

a lattice shielding applied upon at least one of said upper and lower surfaces of the housing and interwoven with the passageways; wherein said lattice shielding is made of intersected strips extending along different oblique directions oblique to both said row direction and said column direction to form a plurality of surrounding units; wherein each of said contacts defines at least one contact arm extending beyond one of said upper and lower surfaces of the housing, and said contact arm is essentially fully surrounded within one corresponding neighboring surrounding unit in a top view.

20. The electrical connector as claimed in claim 19, wherein each of said contacts further includes another contact arm beyond said one of the upper and lower surfaces of the housing and located in another neighboring surrounding unit and opposite said contact arm in either the row direction or the column direction.

* * * * *